US007690635B2

(12) United States Patent
Antonelli et al.

(10) Patent No.: US 7,690,635 B2
(45) Date of Patent: Apr. 6, 2010

(54) CAM DRIVEN INSERT GRIPPER

(75) Inventors: Nicholas Antonelli, Bethel, CT (US); Jeffrey L. Chodack, New Milford, CT (US); Luciano Dos Santos, Danbury, CT (US); Russell W. Holbrook, Southbury, CT (US); Kevin O'Dea, Southbury, CT (US)

(73) Assignee: Pitney Bowes Inc., Stamford, CT (US)

( * ) Notice: Subject to any disclaimer, the term of this patent is extended or adjusted under 35 U.S.C. 154(b) by 231 days.

(21) Appl. No.: 11/963,920

(22) Filed: Dec. 24, 2007

(65) Prior Publication Data

US 2009/0160121 A1 Jun. 25, 2009

(51) Int. Cl.
*B65H 29/00* (2006.01)

(52) U.S. Cl. ..... 270/58.06; 270/52.14; 270/52.01; 270/58.01

(58) Field of Classification Search ..... 270/52.01, 270/52.14, 52.19, 58.01, 58.06; 271/85; 198/377.02, 377.07, 379, 468.2, 470.1, 867.02, 198/867.05, 867.07, 803.3, 803.7, 803.9; 414/729, 739, 741, 796, 796.9, 797.7, 797.8, 414/20, 730–735, 618, 691
See application file for complete search history.

(56) References Cited

U.S. PATENT DOCUMENTS 5,178,262 A * 1/1993 Merkli et al. ..... 198/803.9
6,691,996 B2 * 2/2004 Kaya et al. ..... 270/52.25

* cited by examiner

*Primary Examiner*—Gene Crawford
*Assistant Examiner*—Leslie A Nicholson, III
(74) *Attorney, Agent, or Firm*—Christopher H. Kirkman; Angelo N. Chaclas

(57) ABSTRACT

An apparatus includes a frame, a rotatable first shaft, wherein the first shaft includes a first cam, a rotatable second shaft, an item gripper connected to the second shaft by a connection including a link and an offset shaft rotatably connected to the link, and a linkage. The link is adapted to rotate with the second shaft for pivoting the offset shaft about the second shaft. The item gripper includes jaws adapted to open and close when the offset shaft is axially rotated relative to the link. The linkage connects the first cam on the first shaft to a rider on the offset shaft. The linkage includes a second having a stepped surface for a stepped movement of the rider along the stepped surface to open the jaws during a predetermined angular movement of the offset shaft about the center axis of the second shaft.

15 Claims, 8 Drawing Sheets

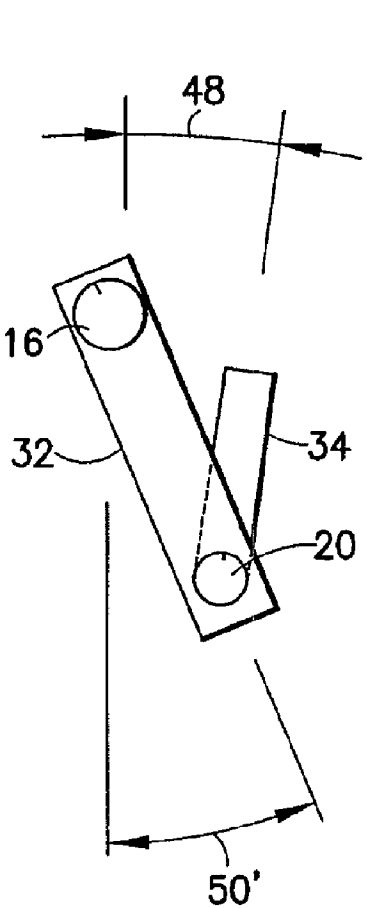
FIG.6
FIG.7
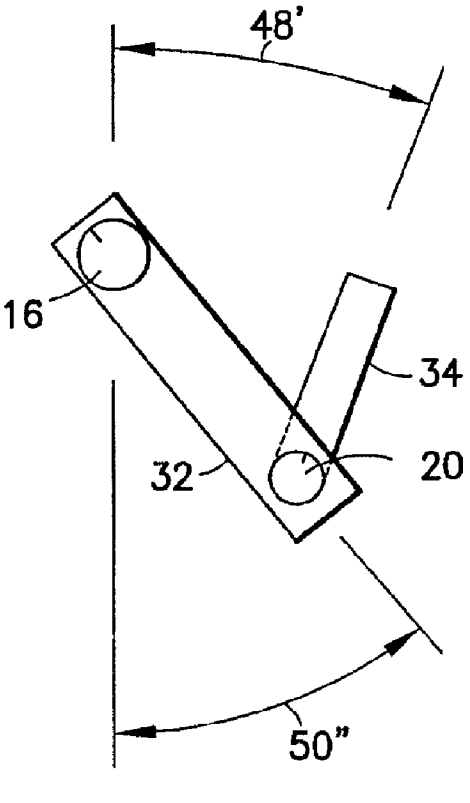
FIG.8

CAM DRIVEN INSERT GRIPPER

FIELD OF THE INVENTION

The invention relates to an apparatus for moving an item and, more particularly, to an apparatus having jaws which open and close to grasp, move, and release an item.

BACKGROUND OF THE INVENTION

Document inserters that collate stacks of different documents into a document assembly and then insert the document assembly into an envelope for mailing are well known. Some document inserters can have a volume of 10,000-20,000 mail pieces per hour or more, for example. During a job change-over, where the size of a document to be assembled into a document assembly is changing, there are a number of job setup steps required for adjustment of the inserter. One of these steps can comprise moving an operator-side chassis side guide either in for smaller material or out for larger material. This allows the material to settle onto the deck between the chassis side guides. By doing this, the operator must also adjust the point during the cycle where the material is released from jaws of a gripper arm. The gripper arm must release the document earlier for a small document and later for a larger document. There is no one location that will work for all document sizes.

One conventional inserter utilizes a set of cams on a lower cam shaft to control the opening and closing of the gripper jaws for both document/material acquisition and document release. The lower cam shaft is driven by the inserter's main motor and runs at a constant rotational speed. Many of the inserter motions are driven by cams that are located on this shaft.

The point in the cycle where the document is acquired by the gripper jaws does not change during normal material change-over. The release point, however, is commonly adjusted for inserts having different sizes. To adjust the release position, one of the cams on the lower cam shaft has to change phase relative to the other. The adjustment of the release position is a time-intensive, trial and error process.

SUMMARY OF THE INVENTION

In the following description, certain aspects and embodiments of the present invention will become evident. It should be understood that the invention, in its broadest sense, could be practiced without having one or more features of these aspects and embodiments. It should also be understood that these aspects and embodiments are merely exemplary.

In accordance with one aspect of the invention, an apparatus is provided including a frame; a rotatable first shaft, wherein the first shaft includes a first cam; a rotatable second shaft; an item gripper connected to the second shaft by a connection includes a link and an offset shaft rotatably connected to the link; and a linkage. The link is adapted to rotate with the second shaft for pivoting the offset shaft about the second shaft. The item gripper includes jaws adapted to open and close when the offset shaft is rotated relative to the link. The linkage connects the first cam on the first shaft to a rider on the offset shaft. The linkage includes a second cam having a stepped surface for a stepped movement of the rider along the stepped surface to open the jaws at a predetermined pivot angle of the offset shaft about the second shaft.

In accordance with another aspect of the invention, a document inserter apparatus is provided comprising a frame forming a path for assembling documents from different stacks of different documents into collated assemblies; a rotatable first shaft connected to the frame, wherein the first shaft comprises a first cam, and wherein the first shaft is located beneath the path; a rotatable second shaft connected to the frame, wherein the second shaft is located above the path; an offset shaft rotatably connected to the second shaft by a link, wherein the offset shaft is located above the path, wherein the link is stationarily connected to the second shaft, wherein the link is adapted to rotate with the second shaft for rotating the offset shaft about a center axis of the second shaft; an item gripper connected to the offset shaft, wherein the item gripper comprises jaws adapted to open and close when the offset shaft is axially rotated relative to the link; and a linkage connecting the first cam on the first shaft to the offset shaft. The linkage comprises a second cam proximate the second shaft and the offset shaft. The second cam comprises a stepped surface to open the jaws during a predetermined angular position of the offset shaft about the center axis of the second shaft while the linkage is stationary. The linkage is adapted to be moved by the first cam to axially rotate the offset shaft relative to the link during a different predetermined angular position of the offset shaft about the center axis of the second shaft. The second cam is adjustably mounted to the linkage to thereby allow the predetermined angular position to be adjusted by a user proximate the second shaft.

In accordance with another aspect of the invention, a method of moving a document by an apparatus having a movable gripper is provided comprising axially rotating a first shaft to thereby move a first cam on the first shaft to move a second cam of a linkage and open jaws of the gripper when the gripper is at a first location; and axially rotating a second shaft to thereby rotate an offset shaft about an axis of the second shaft, wherein the gripper is connected to the offset shaft such that the gripper is moved with the offset shaft about the axis of the second shaft. The second cam comprises a stepped surface for causing the offset shaft to axially rotate during a predetermined angular movement of the offset shaft relative to the second shaft such that the offset shaft opens the jaws of the gripper at a second location while the linkage is stationary.

Aside from the structural and procedural arrangements set forth above, the invention could include a number of other arrangements, such as those explained hereinafter. It is to be understood that both the foregoing description and the following description are exemplary only.

BRIEF DESCRIPTION OF THE DRAWINGS

The foregoing aspects and other features of the invention are explained in the following description, taken in connection with the accompanying drawings, wherein:

FIG. 6 is a diagram illustrating relative positions of the second shaft, offset shaft, and rider of the embodiment shown in FIG. 2 at a first position;

FIG. 7 is a diagram similar to FIG. 6 with the second shaft, offset shaft, and rider of the embodiment shown in FIG. 2 at a second position FIG. 8 is a diagram similar to FIGS. 6 and 7 with the second shaft, offset shaft and rider of the embodiment shown in FIG. 2 at a third position;

DETAILED DESCRIPTION OF EXEMPLARY EMBODIMENTS

Figure 1:
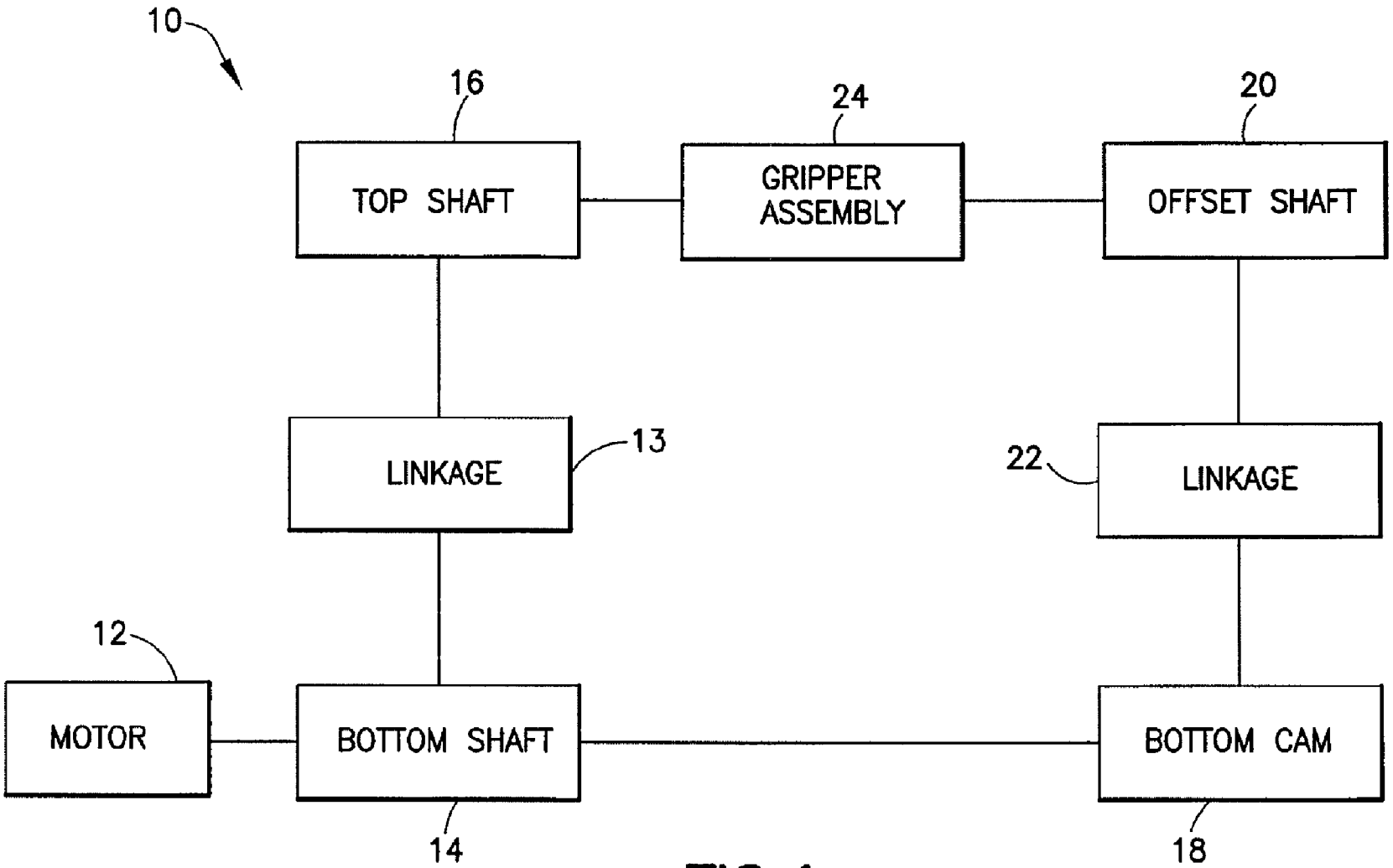
FIG. 1 is a block diagram illustrating some of the components of an embodiment of an apparatus according to the invention.

Referring to FIG. 1, there is shown a block diagram of components of an apparatus 10 incorporating features of the invention. Although the invention will be described with reference to the exemplary embodiment shown in the drawings, it should be understood that the invention can be embodied in many alternate forms of embodiments. In addition, any suitable size, shape, or type of elements or materials could be used.

Figure 2:
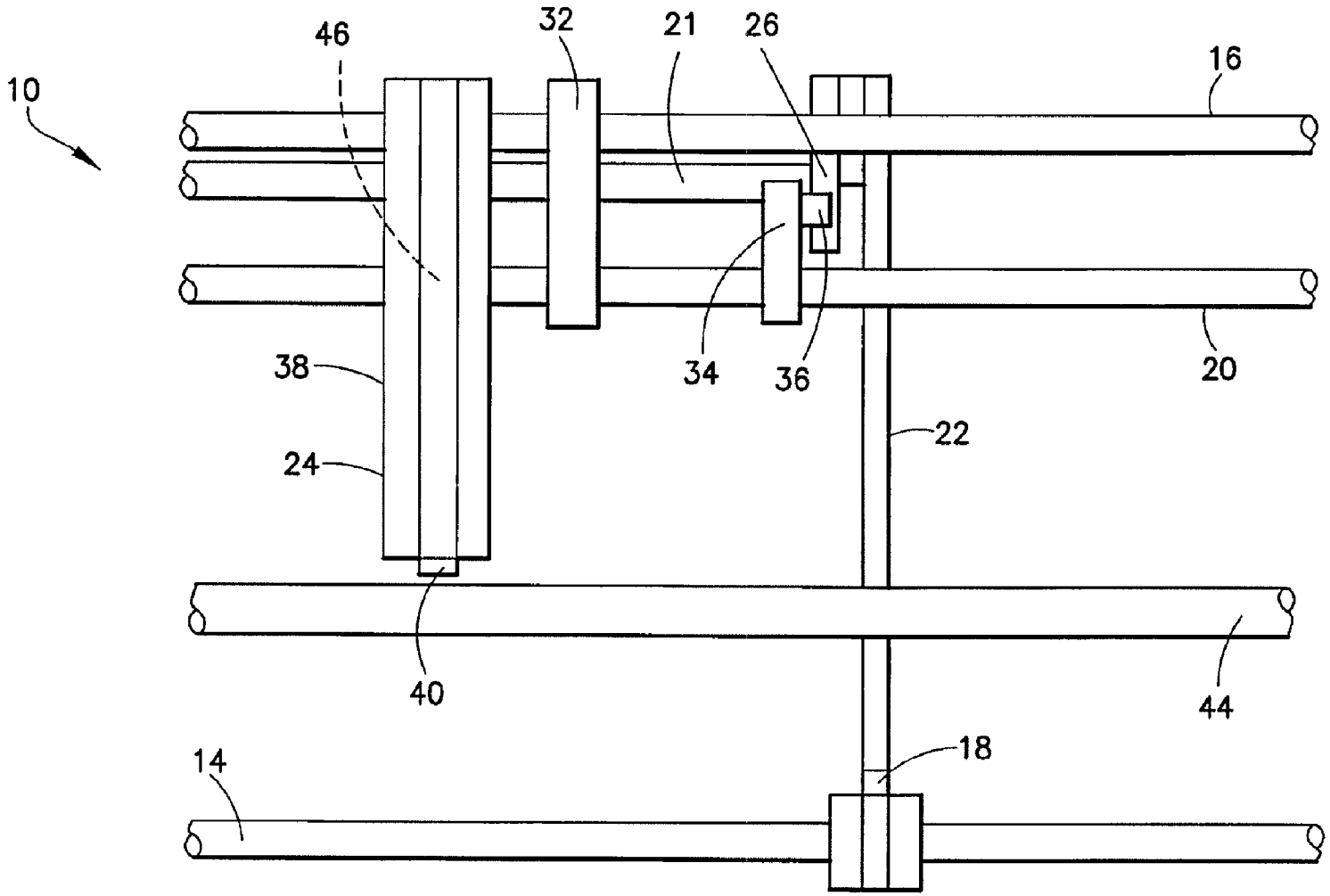
FIG. 2 is a partial front view of an embodiment of the apparatus according to the invention.
Figure 2A:
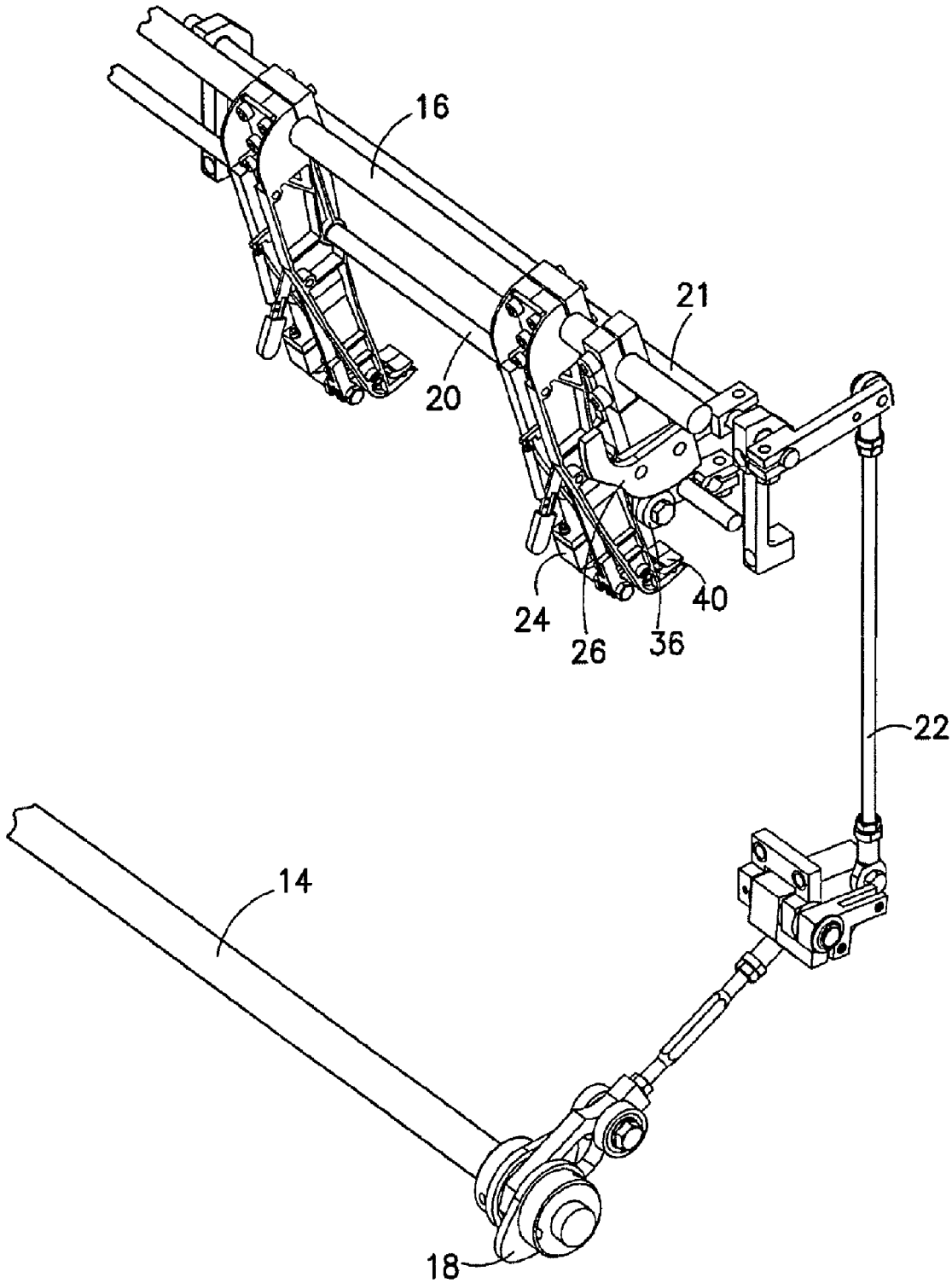
FIG. 2A is a partial perspective view of some of the components shown in FIG. 2.

In the embodiment described below, the apparatus 10 is an inserter adapted to collate items or documents from stacks of different documents into a collated document assembly. Each collated document assembly is then subsequently inserted into a respective envelope. Referring also to FIGS. 2 and 2A, the apparatus 10 comprises a motor 12, a first shaft 14, a second shaft 16, a first cam 18 on the first shaft 14, an offset shaft 20 connected to the second shaft 16, a linkage 22 connecting the first cam to the offset shaft 20, and a gripper assembly 24. The apparatus 10 comprises multiple gripper assemblies 24. However, except for FIG. 2A, only one of the gripper assemblies is shown for the sake of simplicity.

The motor 12 is adapted to drive the first shaft 14 in rotation. The first shaft 14 is connected to the second shaft 16 by a gear box or other connection to provide a reciprocating indexed motion profile or cyclical rotation of less than 360 degrees, such as about 60 degrees, for example. Unlike a conventional inserter, which has two bottom cams on the bottom shaft for controlling grasping and releasing, respectively, of a document by the jaws of the gripper assembly 24, the assembly 10 has only one first cam 18. This first cam 18 is used for controlling the opening of the jaws 40 for subsequently grasping documents by the gripper assembly 24 at a pickup location. The single first cam 18 is not used for opening the jaws 40 for subsequently releasing the documents from the gripper assemblies 24 at a release location.

The first cam 18 is connected to the first shaft 14 and is adapted to move the linkage 22 during a predetermined rotation of the first shaft 14. The top end of the linkage 22 comprises a shaft 21 connected to a stepped cam 26, as shown in FIGS. 2 and 2A. Unlike a conventional cam used in a conventional inserter that has a convex cam surface, the stepped cam 26 has a stepped cam surface 28 which has an additional rise 31 resulting from a transition between different radii, which could also be considered as having a concave recess 30. This can be seen best in FIG. 4.

As seen best in FIG. 2, the offset shaft 20 is connected to the second shaft 16 by a link 32. The link 32 is fixedly attached to the second shaft 16. Thus, the link 32 pivots about the second shaft 16 when the second shaft is rotated. The offset shaft 20 is rotatably connected to the link 32. However, when the link 32 is rotated with the second shaft 16, the offset shaft 20 is pivoted about the second shaft 16.

A rider 34 is fixedly connected to the offset shaft 20. The rider 34 extends radially away from the offset shaft in a general cantilever fashion. The rider 34 has a roller 36 which is located against the surface 28 of the stepped cam 26. With movement of the offset shaft 20 about the center axis of the second shaft 16, and with rotation of the stepped cam 26 by the linkage 22, the roller 36 can travel back and forth along the surface 28 of the stepped cam 26. This is illustrated by the different positions of the roller 36 on the surface 28 shown in FIGS. 4 and 5, including the positions shown in dotted lines. As further understood from the description below, the jaws 40 of the gripper assembly 24 are spring-biased in a closed position. However, the stepped cam 26 may be rotated by the linkage 22 and the first cam 18 to cause the jaws of the gripper assembly 24 to open and subsequently close to grasp an item at a pickup location. However, the stepped cam 26 is stationary when movement of the offset shaft 20 and rider 34 relative to the stepped cam causes the jaws of the gripper assembly 24 to open and thereby release an item from the jaws at an adjustable release location.

The gripper assembly 24 is a conventional gripper assembly well known in the art. The gripper assembly 24 comprises a frame 38, which is connected between the second shaft 16 and the offset shaft 20. The gripper assembly 24 includes top and bottom jaws 40, which are biased by a spring in a closed position. The offset shaft 20 includes cams or dogs 46, which are adapted to open the jaws 40 when the offset shaft 20 is rotated relative to the frame 38.

Figure 3:
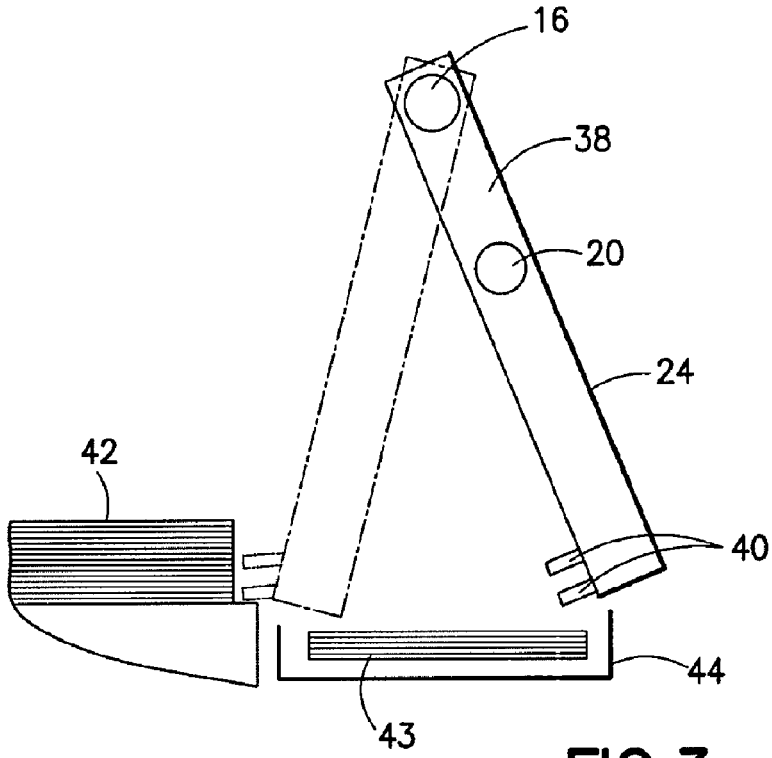
FIG. 3 is a partial end view of some of the components shown in FIG. 2.

FIG. 3 shows the gripper assembly 24 in dotted lines at the pickup (i.e., grasping) location for grasping a document from the stack of documents 42. The apparatus 10 includes an assembly line receiving area 44. The assembly line receiving area 44 forms a conveyer deck to transport the document assemblies 43. The gripper assembly 24 is adapted to grasp one of the documents from the pickup location, pull the document across to the area 44, and then release the document into the area 44 by opening the jaws 40 as shown. With multiple stacks of documents 42 and multiple gripper assemblies 24 along the length of the assembly line receiving area 44, the different documents can be assembled or stacked into collated documents assemblies 43. These collated document assemblies 43 are inserted into envelopes farther downstream along the assembly line receiving area 44.

Figure 4:
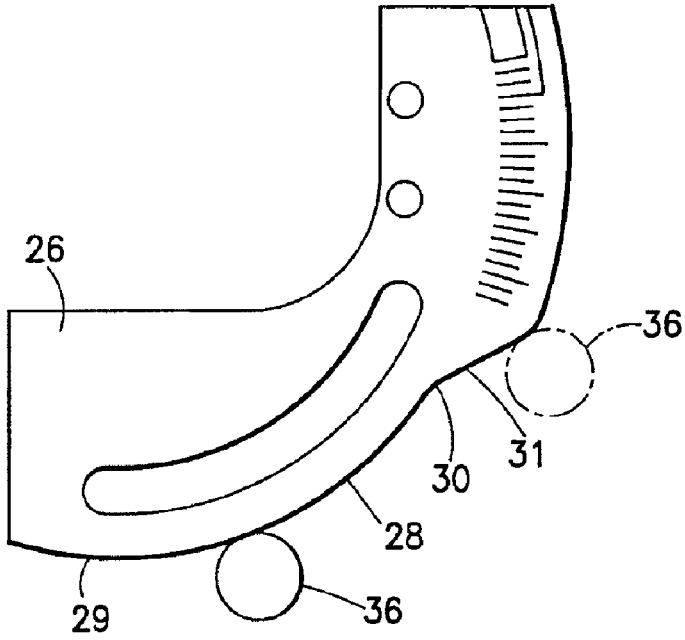
FIG. 4 is a side view of an embodiment of the stepped cam of the apparatus shown in FIG. 2 and a roller of the rider of the apparatus shown in FIG. 2 at a first position.
Figure 5:
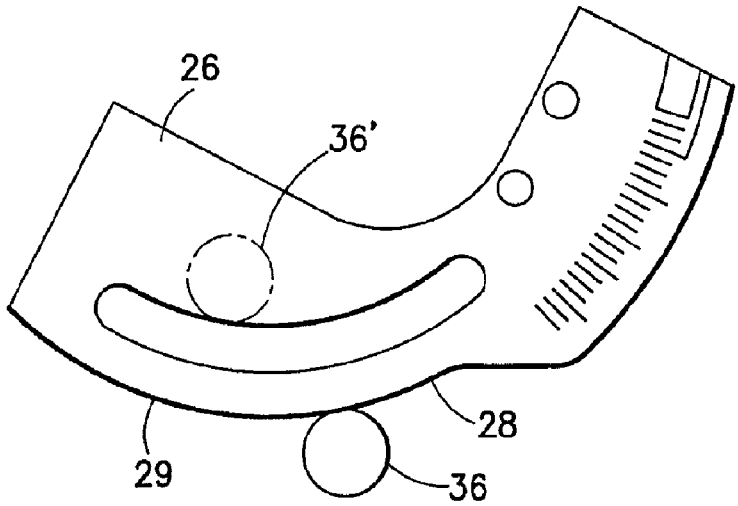
FIG. 5 is a side view similar to FIG. 4 showing the stepped cam and roller at a second position for document pickup.
Figure 10:
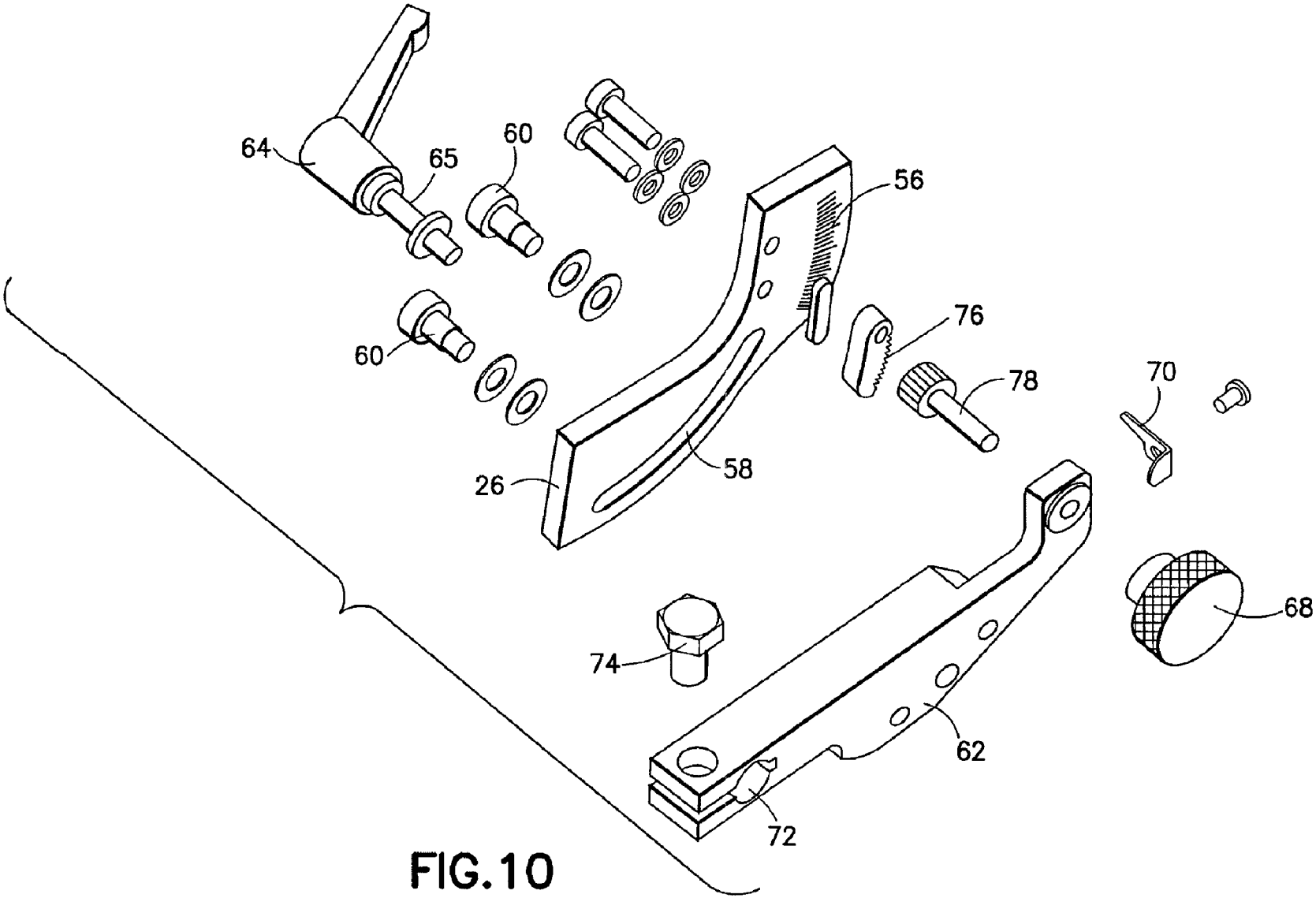
FIG. 10 is an exploded perspective view showing an embodiment of the adjustable connection of the stepped cam of the apparatus shown in FIG. 2.
Figure 11:
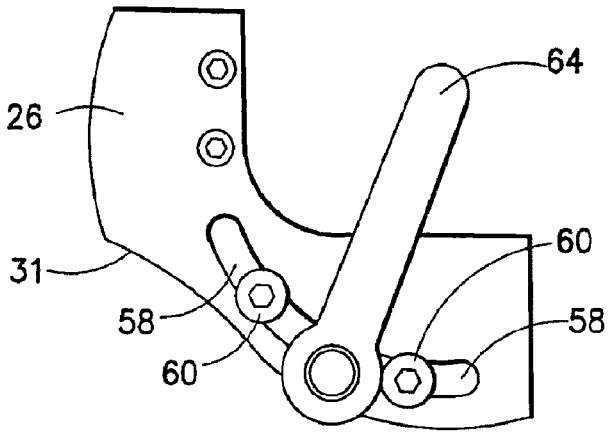
FIG. 11 is a side view of the adjustable connection shown in FIG. 10.
Figure 12:
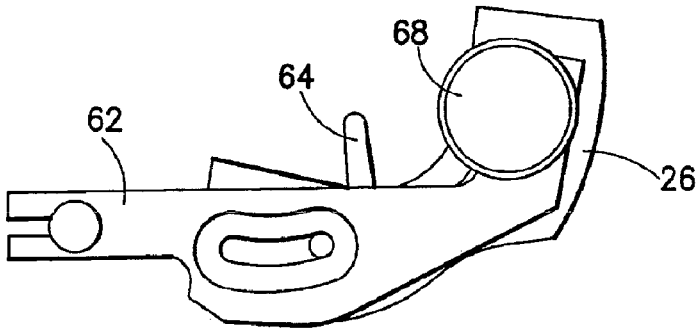
FIG. 12 is an opposite side view of the adjustable connection shown in FIG. 11.
Figure 13:
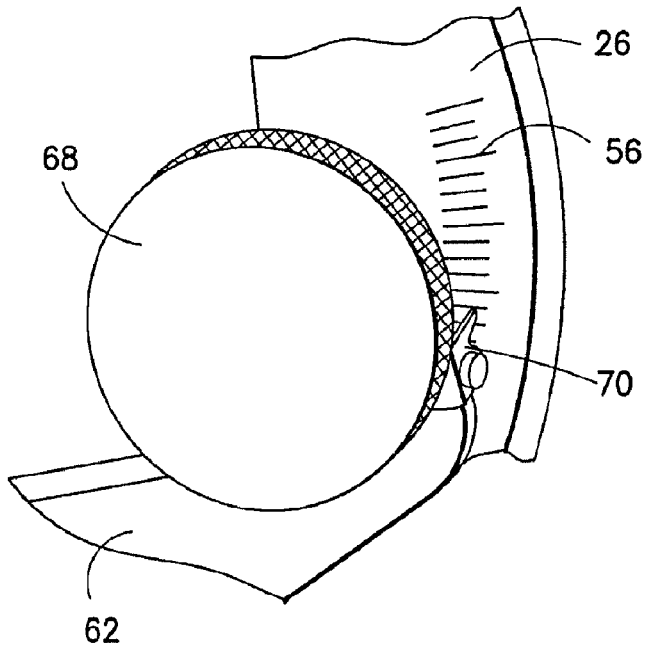
FIG. 13 is an enlarged partial view of adjustment mechanism for moving the stepped cam shown in FIGS. 10-12.

FIG. 4 shows the stepped cam 26 and the roller 36 of the rider 34 at a home position. In this position, the jaws 40 are closed. FIG. 5 shows the stepped cam 26 having been rotated by the linkage 22 and the first cam 18 to move the roller 36 outward from its home position 36', which corresponds to the solid line position shown in FIG. 4. This movement of the roller 36 by the stepped cam 26 causes the rider 34 to rotate the offset shaft 20 about its center axis. This rotation of the offset shaft 20 relative to the gripper assembly 24 causes the jaws 40 to open at the pickup position shown in dotted lines in FIG. 3. The first cam 18 and linkage 22 are then further moved to move the stepped cam back to its position shown in FIG. 4 to allow the jaws 40 to close and thereby grasp one of the documents 42.

With the document 42 grasped by the gripper assembly 24, the second shaft 16 is rotated from the initial position shown in FIG. 6 to the position shown in FIG. 7. In the position shown in FIG. 6, the rider 34 is angled relative to a vertical axis by an angle 48 and the link 32 is angled relative to the vertical axis by an angle 50. As the second shaft is rotated from the position shown in FIG. 6 to the position shown in FIG. 7, the gripper assembly 24 is moved outward from the pickup position shown in dotted lines in FIG. 3 to the release position shown in solid lines in FIG. 3. Angle 50 increases to angle 50'. The stepped cam 26 remains stationary. The roller 30 moves along the surface 28 to the start of the rise 31. Thus, this allows the angle 48 of the rider 34 to remain the same between the two positions shown in FIGS. 6 and 7. This allows the jaws 40 to remain closed until the gripper assembly 24 approaches its release position.

As the gripper assembly 24 approaches its release position the angle 50' increases to angle 50" shown in FIG. 8. The roller 36 moves onto the rise 31 as shown by the dotted lines in FIG. 4. Thus, the stepped cam 26 now causes the rider 34 to rotate the offset shaft 20 as illustrated by the increase in the angle 48 to angle 48' shown in FIG. 8. The rotation of the offset shaft 20 relative to the gripper assembly 24 causes the jaws 40 to open thereby releasing the moved document onto the top of the document assembly 43. The curvature of the surface along section 29 of the surface 28 before the rise 31, thus prevents the jaws from opening during a predetermined angular rotation of the offset shaft 20 about the second shaft 16. However, as the roller 36 moves onto the rise 31 at the final stage of rotation of the offset shaft about the second shaft, the offset shaft 20 is then axially rotated.

With the present invention, axial rotation of the offset shaft 20 relative to the gripper assembly 24 causes the jaws 40 to open and close. At the pickup location, the offset shaft 20 is axially rotated by the first cam 18 and linkage 22 moving the stepped cam 26. At the release location, the offset shaft 20 is axially rotated merely by the shape of the stepped cam 26 as the roller 36 rolls along the rise 31 of the stepped cam. Otherwise, the shape of the stepped cam helps to prevent movement of the jaws 40 as the offset shaft 20 is rotated about the center axis of the second shaft before the roller 36 reaches the rise 31.

Figure 9:
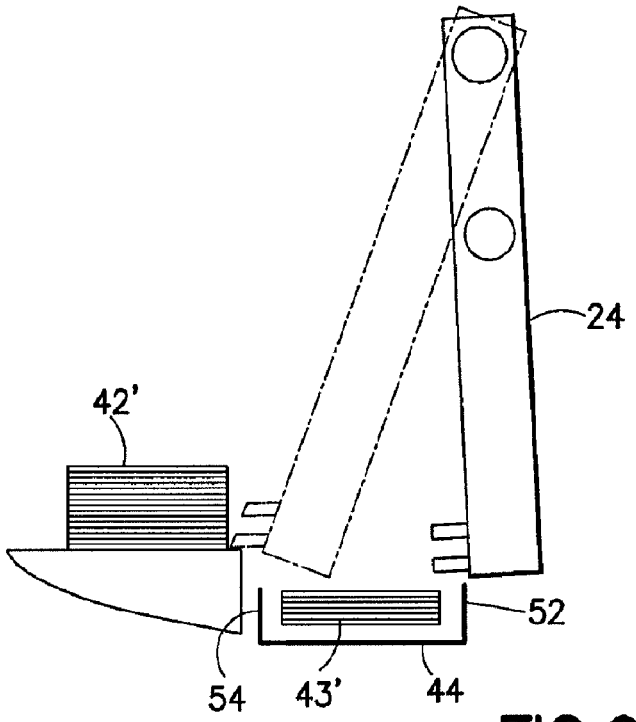
FIG. 9 is an end view similar to FIG. 3 with the apparatus reconfigured for smaller size documents.

As noted above, a job change over for an inserter can comprise changing the size of the documents 42. This can be seen in comparing FIG. 9 to FIG. 3. In FIG. 9, the size of the documents 42' are smaller than the size of the documents 42. To accommodate this change over, the operator-side chassis side guide 52 of the assembly line receiving area 44 can be moved inward. The opposite side guide 54 does not need to be moved. In addition, the pickup location for the gripper assembly 24 and the point at which the jaws 40 close at the pickup position do not need to be changed. However, the location at which the jaws open (the release position for the gripper assembly 24) does need to be changed. With the invention, the stepped cam 26 is adjustably mounted to enable a user to reposition the stepped cam 26 to thereby adjust the position (of the offset shaft about the second shaft) at which the roller 36 starts to move onto the rise 31. For the smaller documents 42' shown in FIG. 9, the roller 36 starts to move onto the rise 31 at a smaller angle of rotation of the offset shaft about the second shaft than the larger documents 42 shown in FIG. 3.

Referring also to FIGS. 10-13, one embodiment of an adjustable mounting of the stepped cam 26 is shown. The stepped cam 26 includes indicia 56 forming an adjustment scale and an elongate slot 58. Fasteners 60 extend through the slot for a slidable attachment of the stepped cam 26 to a frame member 62. The frame member 62 is mounted on the shaft 21, as shown in FIG. 2A, at the opening 72 with a clamping fastener 74. The fasteners 60 are adapted to slide along the slot 58. A clamping lever 64 has a shaft 65 which extends through the slot 58 in the stepped cam 26 and into the frame member 62. With the clamping lever 64 loose, the stepped cam 26 can be moved relative to the frame member 62 by rotating the adjustment knob 68. The adjustable mounting includes a rack 76 attached to the stepped cam 26 and a pinion 78 on the knob 68.

As the knob 68 is rotated, the pinion 78 is rotated to cause the rack 76 and the stepped cam 26 to thereby move relative to the frame member 62. This causes an action to slide the stepped cam 26 along the side of the frame member 62 and thereby adjust the position of the stepped cam on the frame member. However, in alternative embodiments any suitable type of adjustable mounting could be provided. A pointer 70 is provided on the frame member 62, which is used with the indicia 56 to indicate the location of the stepped cam 26 relative to the frame member 62.

When a desired position of the stepped cam is obtained, the user can rotate the clamping lever 64 to lock the position of the stepped cam on the frame member 62. This process may be repeated for further adjustment. As noted above, repositioning the stepped cam 26 adjusts where the jaws 40 open based upon the angular position of the offset shaft 20 about the second shaft 16 at the release position of the gripper assembly.

The device of the invention may increase the ease of adjusting the location for the document release. In addition, the device of the invention may be incorporated into new inserters, as well as being retrofitted into existing inserters, such as the PITNEY BOWES® COMET™ inserter, as well as other inserters and other types of mail and document handling equipment made by other manufacturers.

As described above, the stepped cam may provide a surface having a substantially constant radius that allows the gripper assembly to swing through its angular range of motion. The surface of the stepped cam that forms a rise provides for the gripper release motion. The changing of the release point is accomplished by adjusting the stationary home location of the stepped cam. As the fixed home location of the stepped cam is adjusted, the rise 31 on the stepped cam is shifted back and forth to adjust the point in the cycle where the document is released to the deck of the area 44.

In one embodiment, the position adjustment of the stepped cam may be carried out in a location accessible to an operator. The adjustment may be carried out using the following technique. First, the clamp lever 64 is loosened with the right hand, for example. This allows the stepped cam 26 to move in a sliding motion on the frame member 62. A rack and pinion mechanism 76, 78 is used to allow the operator to adjust the position of the cam. A knob 68 attached to the pinion is turned with the left hand, for example, to drive the cam 26 to its new position. The pinion provides very fine adjustment and a scale and pointer arrangement 56, 70 allows the process to be very repeatable. The clamp lever 64 is then retightened to prevent any drift in position during machine operation.

The invention may provide an operator with the ability to make a timing adjustment to the machine during machine setup without the use of tools or the removal of covers. In an alternative embodiment, the locations of the stepped cam and the rider could be reversed.

It will be apparent to those skilled in the art that various modifications and variations can be made to the structure and methodology described herein. Thus, it should be understood that the invention is not limited to the examples discussed in the specification. Rather, the present invention is intended to cover modifications and variations.

What is claimed is:

1. An apparatus, comprising:

a frame;

a rotatable first shaft connected to the frame, wherein the first shaft comprises a first cam;

a reciprocating rotatable second shaft connected to the frame;

an item gripper connected to the second shaft by a connection comprising a link and an offset shaft rotatably connected to the link, wherein the link is adapted to rotate with the second shaft for pivoting the offset shaft about the second shaft, and wherein the item gripper comprises jaws adapted to open and close when the offset shaft is rotated relative to the link; and a linkage connecting the first cam on the first shaft to a rider on the offset shaft, wherein the linkage comprises a second cam engaging the rider, and wherein the second cam comprises a stepped surface for a stepped movement of the rider along the stepped surface to open the jaws at a predetermined pivot angle of the offset shaft about the second shaft.

2. The apparatus of claim 1, wherein the second cam is mounted to the frame by an adjustable connection that allows a user to select the predetermined pivot angle.

3. The apparatus of claim 2, wherein the adjustable connection comprises a hand movable clamping lever.

4. The apparatus of claim 3, wherein the adjustable connection comprises a rack and pinion gear connection having a knob attached to the pinion allowing manual adjustment of the pinion, and wherein the adjustable connection comprises indicia for indicating a position of the second cam relative to a stationary element of the adjustable connection.

5. The apparatus of claim 2, wherein the adjustable connection comprises a rack and pinion gear connection having a knob attached to the pinion allowing a user to rotate the pinion by hand when the user rotates the knob by hand.

6. The apparatus of claim 2, wherein the adjustable connection comprises indicia for indicating a position of the second cam relative to a stationary element of the adjustable connection.

7. The apparatus of claim 2, wherein the predetermined pivot angle corresponds to a release location of the item gripper.

8. The apparatus of claim 1, further comprising:

a motor connected to the first shaft to drive the first shaft in rotation; and a connection translating the rotation of the first shaft into a reciprocating rotation of the second shaft of less than 360 degrees.

9. The apparatus of claim 8, wherein the second shaft is limited to a reciprocating rotation path of less than 180 degrees.

10. The apparatus of claim 1, wherein the rider is fixedly attached to the offset shaft.

11. The apparatus of claim 10, wherein the rider extends away from the offset shaft in a cantilever fashion.

12. The apparatus of claim 11, wherein the rider comprises a roller configured to follow the stepped surface of the second cam.

13. The apparatus of claim 1, wherein the stepped surface of the second cam has a reduced radius portion and a rise.

14. The apparatus of claim 1, wherein the connection of the item gripper to the second shaft comprises a mechanism configured to actuate the jaws when the offset shaft is rotated relative to the link.

15. A document inserter apparatus comprising the apparatus as in claim 1.

* * * * *